US005738560A

United States Patent [19]

Bears

[11] Patent Number: 5,738,560

[45] Date of Patent: Apr. 14, 1998

[54] SOUND PRODUCING AMUSEMENT DEVICE

[76] Inventor: James Bears, 3317 Nixon Rd., Osgoode Ont., Canada, K0A 2W0

[21] Appl. No.: 644,171

[22] Filed: May 10, 1996

[51] Int. Cl.[6] ..... A63H 3/06; A63H 5/00

[52] U.S. Cl. ..... 446/220; 446/419

[58] Field of Search ..... 446/220, 222, 446/418, 419, 421, 437; 473/594, 595

[56] References Cited

U.S. PATENT DOCUMENTS 3,995,855 12/1976 Schultz .
4,595,200 6/1986 Shishido .
4,798,554 1/1989 Nelson et al. .

*Primary Examiner*—D Neal Muir
*Attorney, Agent, or Firm*—Ronald G. Bitner

[57] ABSTRACT

A sound producing amusement device comprising an inflatable member made of an elastic resilient material, and a handle for supporting and manipulating the inflatable member. A member placed inside the inflatable member produces sound as it rolls or moves inside the inflatable member. The handle is provided with a slot for receiving the open end of the inflatable member for retention and sealing thereof within the handle. Different forms of members placed within the inflatable member produce different sounds, and can simulate different vehicles, animals, etc.

12 Claims, 2 Drawing Sheets

SOUND PRODUCING AMUSEMENT DEVICE

FIELD OF THE INVENTION

This invention relates to a sound producing amusement device.

BACKGROUND OF THE INVENTION

Various types of amusement devices are known which emit sounds. An example of a sound emitting inflated device is disclosed in U.S. Pat. No. 4,595,200 to Shishido.

It would be desirable to provide a simple inexpensive device capable of producing a variety of different sounds.

SUMMARY OF THE INVENTION

An object of the present invention is to provide a simple amusement device for producing sounds.

Another object of the invention is to provide an amusement device that readily allows a variety of different sounds to be produced.

It was found that a simple sound producing device can be provided with a balloon-like inflated member having inside a member, or members, that roll and/or bounce within the balloon when manipulated by means of a suitable handle. It was found that different types of inner members can be used to produce different sounds.

The present invention provides an amusement device comprising an inflatable member made of an elastic resilient material and having an end with an opening for introducing a gas for inflation; a handle for supporting and manipulating the inflatable member, said handle having means for retention of the inflatable member to the handle; and an inner sound generating member for placement within the inflatable member, operative to produce sound upon contact with the inner wall of the inflatable member, when inflated.

DESCRIPTION OF THE PREFERRED EMBODIMENTS

Figure 1:
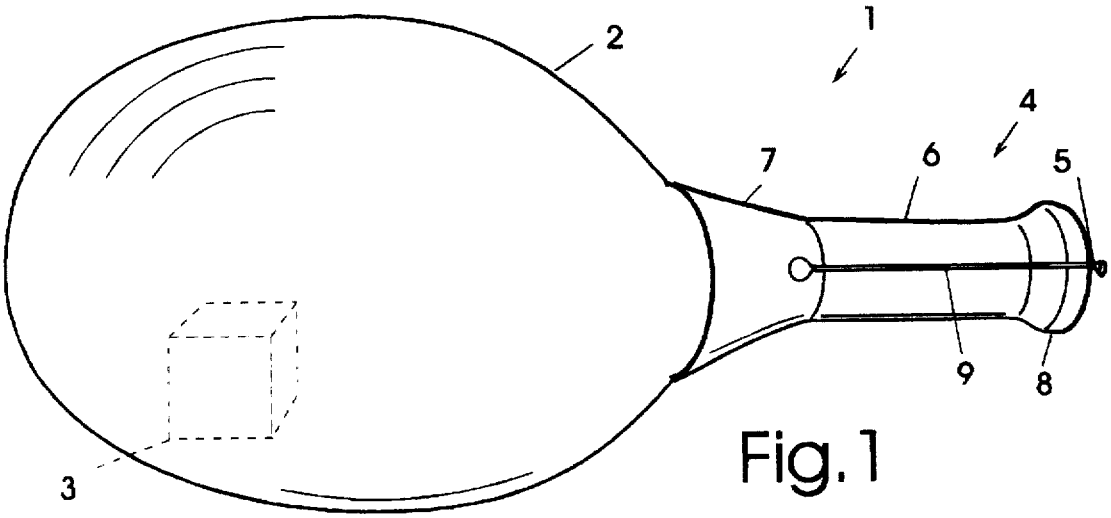
FIG. 1 illustrates one embodiment of the invention.

With reference to FIG. 1, which illustrates one embodiment of the invention, the device 1 comprises an inflatable member 2, shown in the form of a balloon, an inner sound generating member 3, and a handle 4 for supporting and manipulating the inflatable member 2.

The inflatable member 2 is made of an elastic resilient material and has an end portion 5 with opening for inserting the sound generating member, or members 3, and for introducing a gas for inflation.

Figure 3:
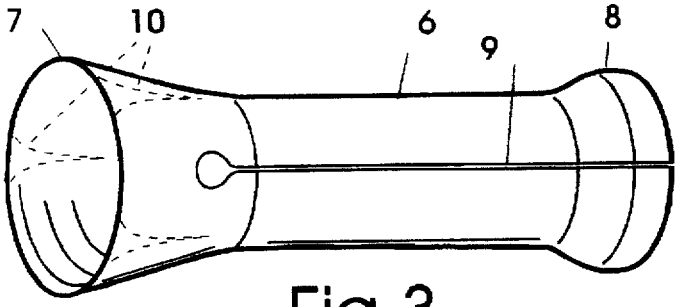
FIG. 3 is an enlarged view showing details of the handle used in FIG. 1.
Figure 4:
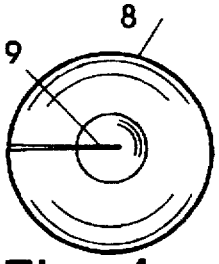
FIG. 4 is an end view of the handle shown in FIG. 2.

With reference to FIGS. 1, 3 and 4, the handle 4 comprises an annular wall portion 6 defining an open flared end 7 for receiving the inflated member 2, an opposite end 8 having a slot 9 for receiving the end 5 of the inflated member, and an intermediate handle portion 10. The handle 4 can take various forms, for example, the larger diameter flared end 7 can include cut-out portions 10 that allow collapsing of the flared end 7 to provide compactness for shipping, or when not in use.

It should be noted that the flared end 7 of the handle 4 does not merely hold the inflated member 2 but must be able to support and retain it in position when the device is waved or otherwise manipulated to produce sound. For this purpose, the flared end 7 will preferably have a diameter at least ⅕ of the inflated member 2.

With reference to FIG. 4, the slot 9 in the handle is preferably adapted for both retention and sealing of the open end 5 of the inflated member 2, without the need to tie or otherwise close the end. This is achieved by making the width of the slot 9 sufficiently narrow such that the end 5 of the inflated member must be forced into place thereby providing compressing the end portion 5.

Figure 2:
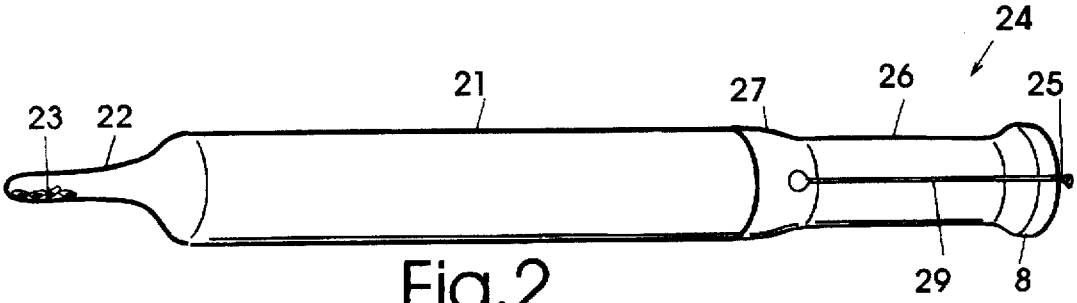
FIG. 2 illustrates another embodiment of the invention.

A balloon provides the desired elastic properties for the inflated member 2. The inflatable member may take various shapes, for example, elongated in the shape of a baton as shown in FIG. 2.

For use, the walls of the inflatable member 2 must be taut or stretched, which can be conveniently done by inflation with air or other gas. It will be appreciated that the inflatable member may be provided to the user in deflated form to reduce volume for shipping.

The inner member or members 3 produce sound when they roll along the inner wall or otherwise strike inner walls of the inflated member 2. The inner members produce vibrations in the wall of the inflated member when they roll and/or strike the wall, similar to the beating of a drum, thereby producing a relatively loud sound emission. It appears that resonances within the inflated member contribute to the amplification of sound.

The handle 4 supports and retains the inflatable member 2 allowing swinging or manipulation of the inflated member for producing sounds. However, the handle should contact a limited surface of the inflated member 2, since it is the free vibrating surfaces of the inflated member that emit the major portion of the sound.

Figures 5, 6:
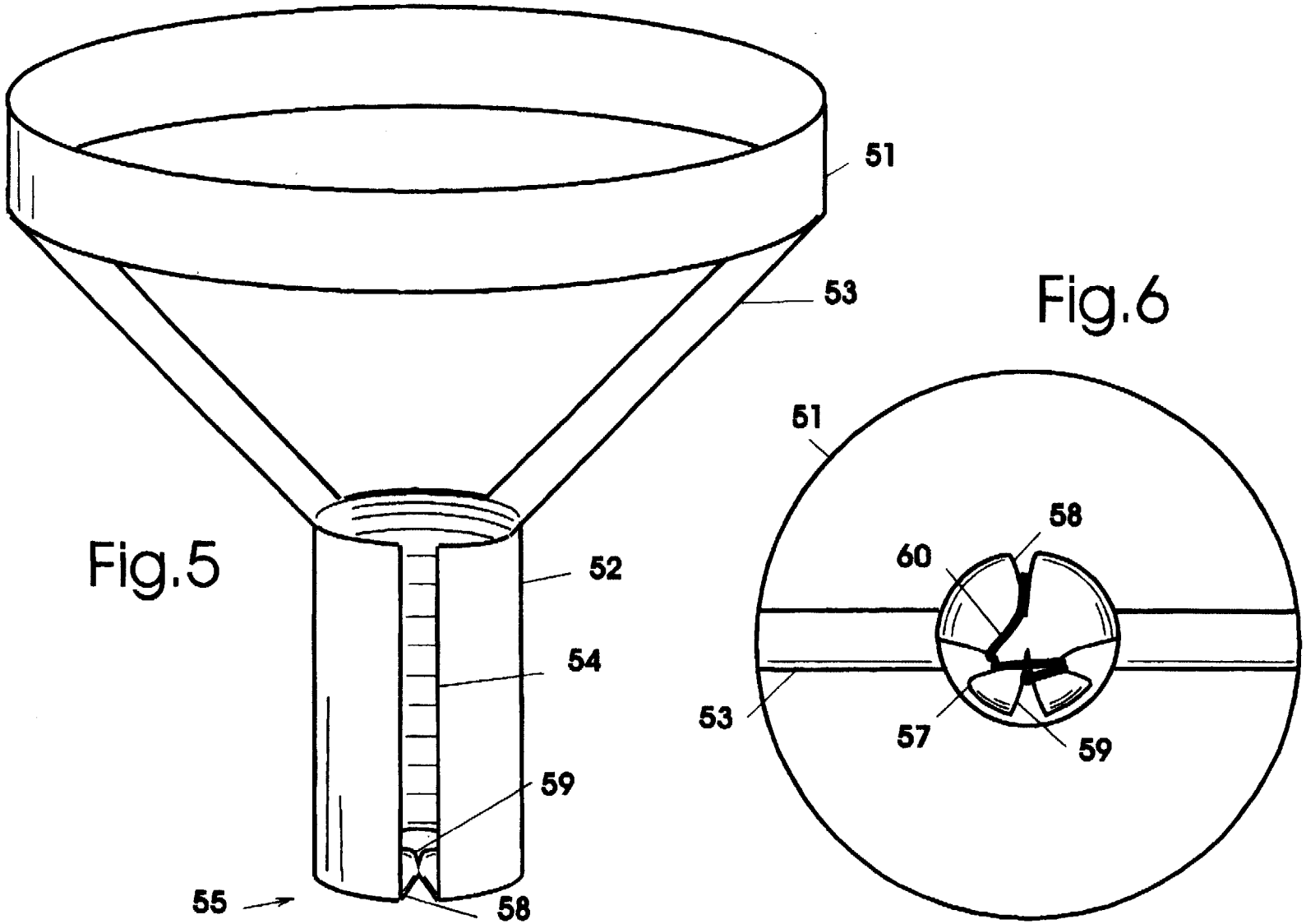
FIG. 5 is another embodiment of a handle for the invention.
FIG. 6 is an end view of the handle shown in FIG. 5.

FIGS. 5 and 6 illustrate another embodiment of a handle for the present invention. The handle includes a balloon engaging rim portion 51 connected to the handle portion 52 by means of two connecting members 53. The use of two connecting members 53, as shown, allows the rim portion to be collapsed for compactness for shipping or storage. A slot 54 facilitates access for connection of the end of the balloon. The end wall 55 of the handle has cut-outs that define retaining and sealing means for the end of inflatable member.

FIG. 6 shows details of the end wall which incorporate another embodiment of the retention means for the end of the inflated member. The end wall defines a generally T-shaped element 57 and slots 58 and 59. The T-shaped member 57 is adapted for wrapping of the end 60 of the inflated member, which allows slack to be taken-up to maintain the desired tension in the stretched balloon to secure it in place. The user may inflate the balloon to various degrees which results in differing amounts of slack to be taken up at the end of the handle. The wrapping also helps to assure that the balloon is sealed air-tight. In addition to providing retention, the slots 58 and 59 also facilitate reliable sealing of the end 60 of the balloon with a simple procedure that does not require much skill on the part of the user.

Figure 7A:
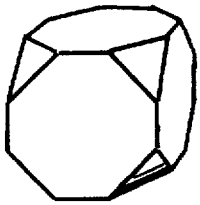
FIGS. 7*a* and 7*b* illustrate embodiments of inner sound generating members for use in the present invention.
Figure 7B:
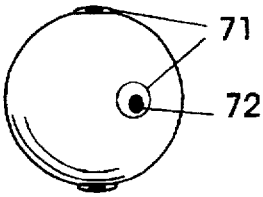

The present invention can be provided with various forms, shapes, and sizes of inner members, singly or in combination with like or different members, that provide various types of sounds when they roll along or otherwise move within the inflated member when the device is manipulated. Examples of suitable members are shown in FIGS. 7*a* and 7*b*, and a discussion of the type of sounds obtained are described below.

The inner members will preferably be provided with irregularities to provide protruding regions that impact the inner wall of the inflated member as they roll. For example, the inner member, or members, can be in for form of cube, polyhedron, truncated sphere, or other irregular object, and may be composed of hard or soft material, or a combination of these.

For particularly interesting and complex sounds the inner member(s) includes a loose element which additionally provides a rattling or jingling sound. For example, a small flattened member with loose element can be added to the surface of a spherical or other shaped member. This can be conveniently provided with tacks having a loose plastic surface, or with small flattened containers glued, or otherwise attached to the surface of the larger member and which have loose object inside. The latter is illustrated in FIG. 7*b*, showing a flattened containers 71 with loose inner object 72. The inner member can be hollow or have a hollow portion or portions for containing a loose element or elements.

With a suitable combination of components the sounds of various vehicles or animals can be simulated. For example, foam balls with small attached flattened plastic containers 71 with inner loose object 72, as illustrated in FIG. 7*b*, produced the sound of an airplane. A ping-pong ball with similar attached plastic containers produced the sound of a car. A rubber ball with embedded tacks produced a race car sound. A polyhedron made from a cube of hard rubber with corners cut off, as shown in FIG. 7*a*, produced the sound of a motor bike. A larger polyhedron produced the sound of a diesel engine. Two unequally sized cubes of hard rubber (1.2 cm and 0.6 cm) produced sounds similar to elephant trumpeting. A foam ball produced a purring sound, and a truncated foam ball produced a growling sound. A cricket or bumblebee sound was produced with the use of jinglebells. The sound of hail on a tin roof was produced using a rubber ball with elastic filaments protruding from the surface. As such ball rolls along, the filaments beat the inner surface of the balloon producing intense sound.

With reference to FIG. 2, simulation of a rattlesnake, including both visual and sound effects, was provided with an elongated balloon 21 that was not completely inflated leaving a reduced diameter "rattle" end 22, in combination with a number of inner members 23 in the form of a plurality of small plastic containers with a loose inner plastic element inside. These can be similar to the elements 71 as shown in FIG. 7*b*. Other components, such as the handle 22, can be similar to that of FIG. 3, including a balloon receiving flared portion 27 and slot 29.

Generally, a protruding element on the inner member produces a drumming component to the sound, while a loose element provides adds a rattling, clicking or metallic sound. With an inner member as shown in FIG. 7*b*, both sound effects are obtained. The pitch of the sound varies inversely with the size of the inner object.

It will be appreciated that the number, shape, size, mass and number of inner members can be varied for producing different kinds of entertaining sounds and visual effects.

What is claimed is:

1. An amusement device comprising:

an inflatable member made of an elastic resilient material, said inflatable member having an inner wall and an end with an opening for introducing a gas for inflation;

a handle for supporting and manipulating the inflatable member, said handle comprising an annular wall portion defining an open end for receiving one end of the inflatable member, and an opposite end wall having a slot for receiving the end of the inflatable member for retention thereof within the handle, and wherein the open end of the handle has a diameter of not less than ⅕ of the diameter of the inflatable member, when inflated; and an inner rollable sound generating member for placement within the inflatable member, said inner member having an irregular surface defining a plurality of points for making contact with the inner wall of the inflatable member and wherein the inner member includes a loose element retained adjacent the surface thereof, the inner member being operative upon manipulating the handle with the inflatable member inflated and retained thereby, to produce sound upon rolling contact with the inner wall of the inflatable member.

2. The device of claim 1 wherein the inflatable member is a balloon.

3. The device of claim 1 wherein the inflatable member is elongated.

4. The device of claim 1 wherein, in operation, the inflatable member is inflated to provide a taut rebounding inner wall surface for the inner member.

5. The device of claim 1 where the inner member comprises a non-spherical member.

6. The device of claim 1 wherein the inner member includes protruding elements.

7. The device of claim 1 wherein the inner member is a polyhedron.

8. The device of claim 1 wherein the inner member includes a hollow portion, and wherein the loose element is disposed within the hollow portion.

9. The device of claim 1 comprising a plurality of inner members.

10. The device of claim 1 wherein the annular wall portion of the handle is flared to receive one end of the inflatable member.

11. The device of claim 1 wherein the handle comprises a first and second annular portion interconnected by a pair connecting members.

12. The device of claim 1 wherein the end wall of the handle comprises a cut-out portion defining a T-shaped portion for wrapping of the end of the inflatable member, and a second slot for retention of the end of the inflatable member.

* * * * *